US008227993B2

(12) United States Patent
Neate et al.

(10) Patent No.: US 8,227,993 B2
(45) Date of Patent: Jul. 24, 2012

(54) LAMP HAVING AN ELECTRODELESS BULB

(75) Inventors: Andrew Neate, Bukinghamshire (GB); Charles Guthrie, San Jose, CA (US)

(73) Assignee: Ceravision Limited, Milton Keynes (GB)

( * ) Notice: Subject to any disclaimer, the term of this patent is extended or adjusted under 35 U.S.C. 154(b) by 640 days.

(21) Appl. No.: 12/224,344

(22) PCT Filed: Jun. 2, 2006

(86) PCT No.: PCT/GB2006/002018

§ 371 (c)(1),
(2), (4) Date: Sep. 16, 2008

(87) PCT Pub. No.: WO2006/129102

PCT Pub. Date: Dec. 7, 2006

(65) Prior Publication Data

US 2010/0060167 A1 Mar. 11, 2010

Related U.S. Application Data

(60) Provisional application No. 60/687,280, filed on Jun. 3, 2005.

(51) Int. Cl.
*H05B 37/00* (2006.01)

(52) U.S. Cl. ..... 315/39; 315/248

(58) Field of Classification Search ..... 315/39, 315/248; 313/634, 636

See application file for complete search history.

(56) References Cited

U.S. PATENT DOCUMENTS

| | | | | |
|---|---|---|---|---|
| 5,570,068 | A | 10/1996 | Quan | |
| 5,867,073 | A | 2/1999 | Weinreb et al. | |
| 6,031,333 | A * | 2/2000 | Simpson | 315/39 |
| 6,313,587 | B1 | 11/2001 | MacLennan et al. | |
| 6,737,809 | B2 | 5/2004 | Espiau | |
| 2005/0057158 | A1 | 3/2005 | Chan et al. | |

FOREIGN PATENT DOCUMENTS

| | | |
|---|---|---|
| EP | 0603014 | 6/1994 |
| EP | 0671758 | 9/1995 |
| FR | 2290126 | 5/1976 |
| FR | 2462787 | 2/1981 |
| WO | WO0127962 | 4/2001 |
| WO | WO2004070762 | 8/2004 |

* cited by examiner

*Primary Examiner* — David Hung Vu

(74) *Attorney, Agent, or Firm* — Bay State IP, LLC; Adam J. Bruno

(57) ABSTRACT

A lamp with a quartz electrodeless bulb has a ceramic wave guide with a central void, in which the bulb is accommodated. The wave guide is rectangular. The central void is centered on a central longitudinal plane of the wave guide, normal to front and back faces of the wave guide and equally spaced from end faces. Parallel with the central void and also on the central plane are two further voids for respective antennae. The central void is open through the front face for egress of light, but the antenna voids are not open in this face. The latter is metalized to inhibit egress of microwave energy from the wave guide.

9 Claims, 6 Drawing Sheets

LAMP HAVING AN ELECTRODELESS BULB

CROSS REFERENCE TO RELATED APPLICATION

This application is for entry into the U.S. National Phase under §371 for International Application No. PCT/GB2006/002018 having an international filing date of Jun. 2, 2006, and from which priority is claimed under all applicable sections of Title 35 of the United States Code including, but not limited to, Sections 120, 363 and 365(c), and which in turn claims priority under 35 USC 119 to U.S. Patent Application No. 60/687,280 filed on Jun. 3, 2005.

BACKGROUND OF THE INVENTION

The present invention relates to a lamp having an electrodeless bulb.

DESCRIPTION OF THE RELATED ART

Electric lamps generally comprise either incandescent ohmic filament bulbs and suitable fittings or discharge bulbs usually with electrodes for exciting their discharge. The resultant radiation is not always visible, in which case, the bulb is lined with phosphorescent material to provide visible light. It is known also to provide a bulb without electrodes and to excite it by applying external radiation, in particular microwave energy.

Such a bulb using a microwave source is described in U.S. Pat. No. 6,737,809, the abstract of which is as follows:

A dielectric waveguide integrated plasma lamp with a body consisting essentially of at least one dielectric material having a dielectric constant greater than approximately 2, and having a shape and dimensions such that the body resonates in at least one resonant mode when microwave energy of an appropriate frequency is coupled into the body. A bulb positioned in a cavity within the body contains a gas-fill which when receiving energy from the resonating body forms a light-emitting plasma.

In the '809 patent, the bulb is formed by enclosing the cavity with a window sealed over the cavity, the window enclosing the gas fill. Such a lamp is not easy to manufacture.

SUMMARY OF THE INVENTION

In our International patent application No. PCT/GB2005/005080 filed on 23, Dec. 2005, we described manufacture of an electrodeless incandescent bulb comprising:

- a length of circularly cylindrical quartz tube;
- end closures/seals across the length of the tube;
- polished transverse surfaces of the end closures/seals; and
- a fill of excitable material.

In this specification, we refer to this bulb as "Our Quartz Electrodeless Bulb".

The present invention is particularly suited to Our Quartz Electrodeless Bulb, but we can envisage its use with other bulbs.

The object of the present invention is to provide an improved lamp using Our Quartz Electrodeless Bulb According to the invention there is provided a lamp having a lamp having an electrodeless bulb, the lamp comprising:

- a drive device adapted to drive at least two antennae;
- a ceramic wave guide;
- at least two respective voids receiving the said antennae in the wave guide; and

- a central void in the wave guide, for receiving the bulb, equally spaced from the antenna voids, the central void having:
  - a physical opening through which light can pass from the bulb and out of the wave guide.

In our preferred lamp, the bulb is one of Our Quartz Electrodeless Bulbs.

We have found that we can use wire antennae or other shaped antenna terminations particularly those having a cross-sectional dimension of the same order of magnitude as the bulb, as well as mere wires of smaller diameter. For instance, the antennae may have spherical or circular cylindrical terminations. Proximal ends of the antenna are preferably wire-like for soldered connection with a circuit board.

The bulb and antenna voids are preferably circularly cylindrical.

In the preferred embodiment, where two antennae are provided, the length of the waveguide in the direction from one antenna void to the other is one quarter wave length, with the antennae one eighth wave length from the nearest end of the guide and from the central, lamp void. We have found this to be compact, yet the resultant lamp is powerful. Whilst we can envisage other shapes, which are symmetrical with respect to the bulb, such as circular or elliptical for reflecting radiation back towards the lamp, our preferred wave guide is rectangular, with ends normal to the central plane in which the antennae are arranged.

As an alternative to two antennae, we can envisage the use of three antennae in the wave guide, these antennae being equally radially spaced around the bulb. In such an arrangement, we envisage the wave guide to be of circular cross-section, centred on the bulb void.

Whilst we envisage that it may be possible to provide microwave oscillator and amplifier circuits on a printed circuit board abutting the wave guide, we prefer to provide the oscillator and amplifier circuits in a microwave driver remote from the lamp and connected thereto by a lead and to provide a splitter circuit only on the circuit board.

Thus in accordance with a particular preferred feature of the invention, the drive device includes:

- a printed circuit board carrying:
  - splitter circuit, the circuit being a conductive track having:
    - a input connection for a cable from a microwave driver,
    - a common portion and
    - a bifurcation to two output connections for the two antennae.

The splitter circuit splits the microwave energy into two in-phase portions, for driving the antennae in-phase.

In the preferred embodiment, the splitter circuit has a reflective element between an input connection from the cable and the antennae, for reflecting back towards the antennae energy itself reflected from the antennae and/or the output connections.

BRIEF DESCRIPTION OF THE DRAWINGS

To help understanding of the invention, a specific embodiment thereof will now be described by way of example and with reference to the accompanying drawings, in which.

DETAILED DESCRIPTION OF THE PREFERRED EMBODIMENT

Figure 1:
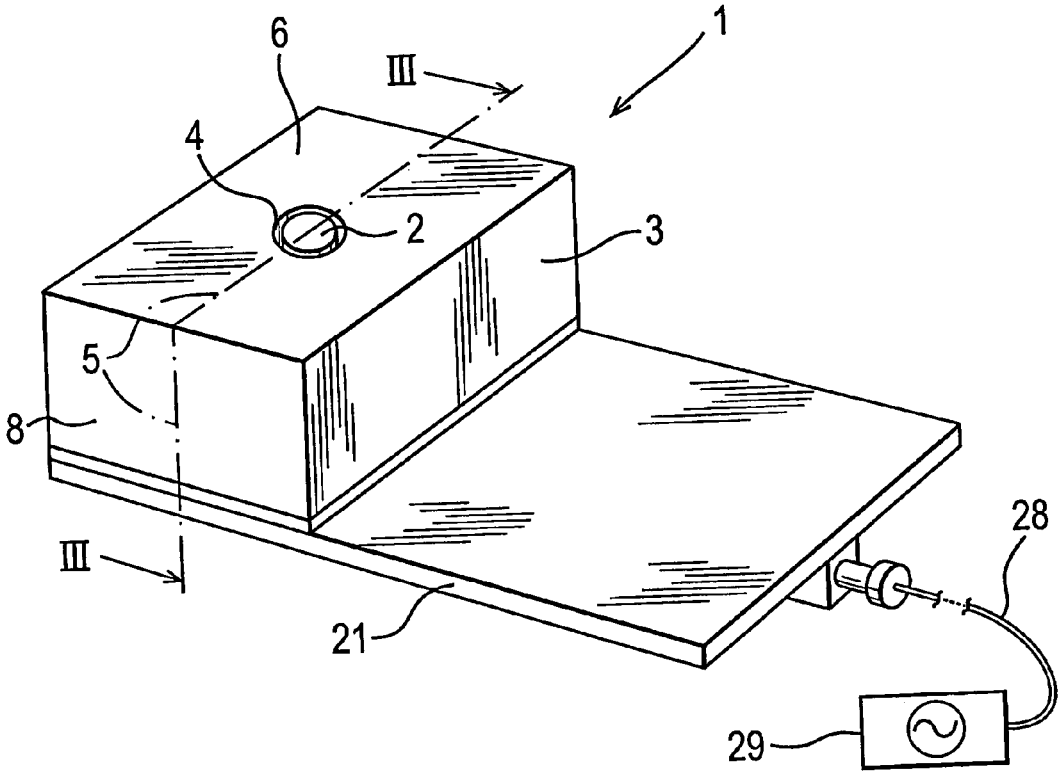
FIG. 1 is a perspective view of an electrodeless bulb drive device in accordance with the invention, showing a wave guide and a printed circuit board for a splitter circuit.
Figure 2:
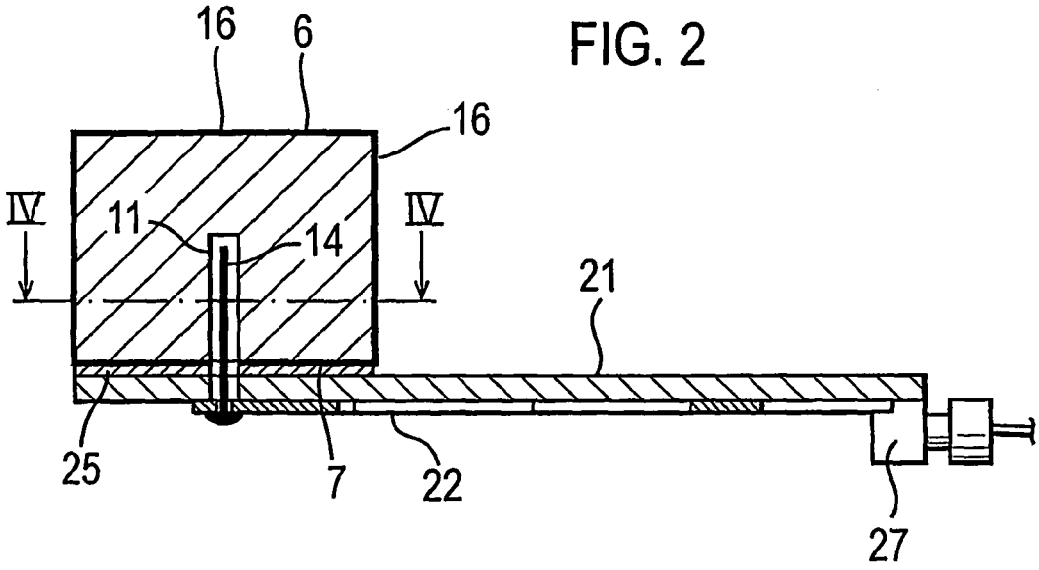
FIG. 2 is cross-sectional side view of the device of FIG. 1, the section being on the plane II-II as shown in FIGS. 3 & 4.
Figure 3:
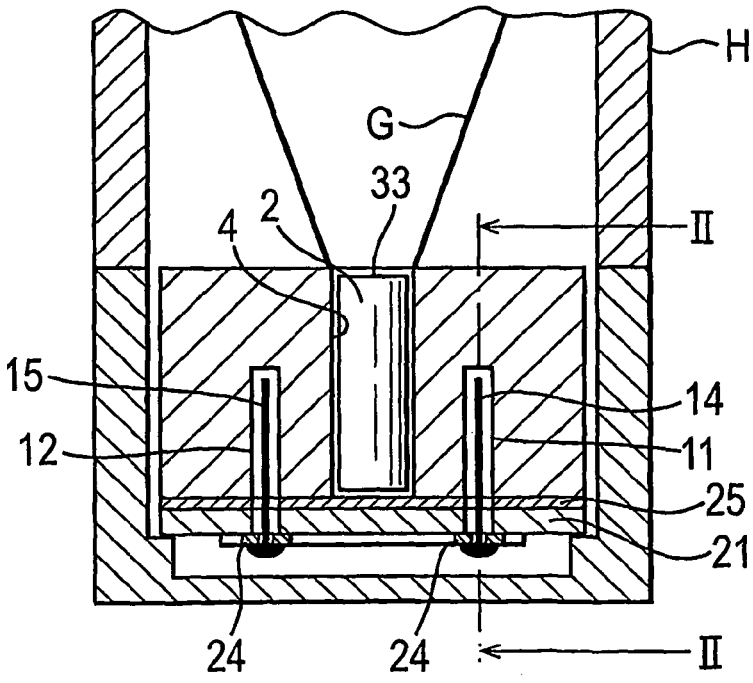
FIG. 3 is a cross-sectional end view of the device on the central plane 5 shown in the direction of the arrows III-III shown in FIG. 1, also including a housing and a light collimator not shown in the other Figures.

Referring to FIGS. 1 to 5 of the drawings, a lamp 1 with a quartz electrodeless bulb 2 has a ceramic wave guide 3 with a central void 4, in which the bulb is accommodated. The wave guide is rectangular. The central void is centred on a central longitudinal plane 5 of the wave guide, normal to front and back faces 6,7 of the wave guide and equally spaced from end faces 8,9. Parallel with the central void and also on the central plane 10 are two further voids 11,12 for respective antennae 14,15. The central void is open through the front face for egress of light, but the antenna voids are not open in this face. The latter is metalised 16 to inhibit egress of microwave energy from the wave guide.

Figure 4:
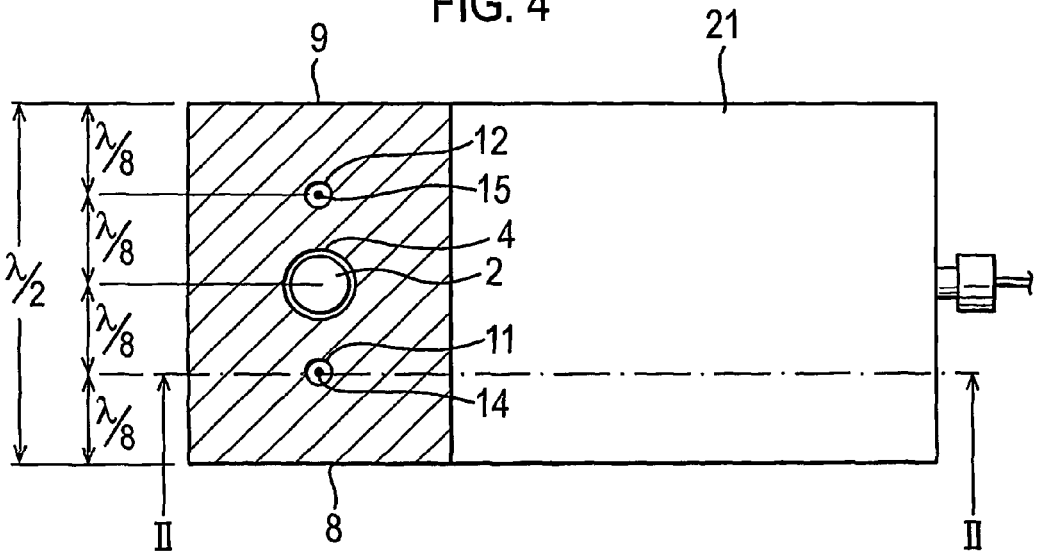
FIG. 4 is a cross-sectional plan view of the device, on the line IV-IV in FIG. 2.
Figure 5:
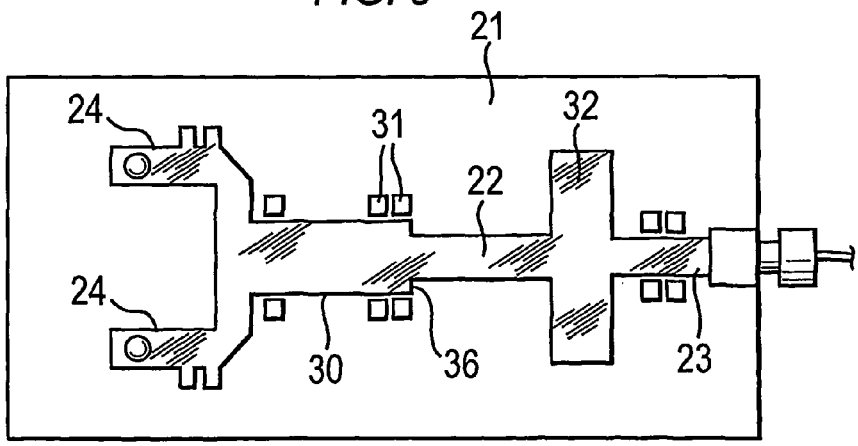
FIG. 5 is an equivalent underneath view of the device.

In length between its end faces 8,9, the wave guide is one half wave length, that is one half the wave length of the microwave radiation that is propagated from the antennae to the bulb. Typically, the microwave frequency is 2.4 GHz with 80 MHz bandwith, the wavelength being 68.6 mm and the length between the faces being 34.3 mm. The antenna voids are spaced equally from the central void and the end faces, that is $1/8^{th}$ wavelength from each. This spacing is shown in FIG. 4.

The bulb is typically 6.0 mm in diameter, with its void being a clearance diameter therefor, namely 6.3 mm. The antennae 14,15 are copper wires of a diameter to be self-supporting during manufacture of the lamp, typically of 1.5 mm diameter. The antennae voids are 2.0 mm in internal diameter.

At the front of the device is mounted a light guide G, which forms no part of this invention. Behind the wave guide, a printed circuit board 21 is located. Both it and the wave guide are accommodated in a metallic housing H, shown in partial outline only. The housing maintains the wave guide 3 and the circuit board in their relative positions. It also encloses the circuit board and provides a shield against escape of microwave radiation.

The circuit board carries a copper track 22, which is generally Y-shaped, with an input end 23 and a pair of output ends 24. It is configured as a Wilkinson splitter, except that such a splitter has a load connected across its output ends. In the invention, there is no single component connecting the output ends, to which the antennae are connected with dielectric material of the wave guide and the bulb therebetween. The output ends are connected by solder to the wire antennae 14,15. The track 22 is provided on the side of the board 21 remote from the wave guide. A thermal insulation board 25 is provided between the wave guide and the board, without which the antenna voids 11,12 would be open to the circuit board. As shown, the insulation board locates the wire antenna 14,15 in their approach towards the board. They are located in the opposite direction, by the ends 26 of their voids in the wave guide.

The input end of the splitter circuit has a conventional microwave circuit connector 27, for a cable 28 from a remote drive circuit 29 incorporating an oscillator and an amplifier (not shown).

Alongside the stem 30 of the splitter circuit are provided a number of small tuning spots 31, which can be solder connected to the stem for tuning as required. Further, laterally of the stem are provide a pair of ears 32, positioned to adjust the impedance of the circuit and to direct back towards the antennae microwave energy reflected from the output ends 24 and the antennae. Between the ears 32 and the output ends 24, the circuit is stepped in width 36. This also is a local impedance tuning feature.

The length of the splitter circuit is one wave length, the actual length being influenced by the dielectric constant of the material of the board 21, on which the circuit is deposited.

Figure 6:
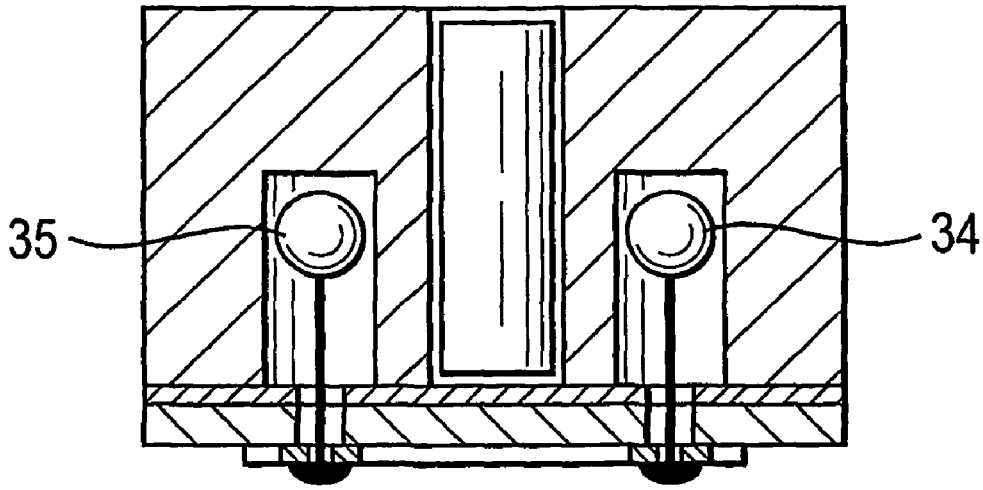
FIG. 6 is a view similar to FIG. 3 showing an alternative antenna configuration.
Figure 7:
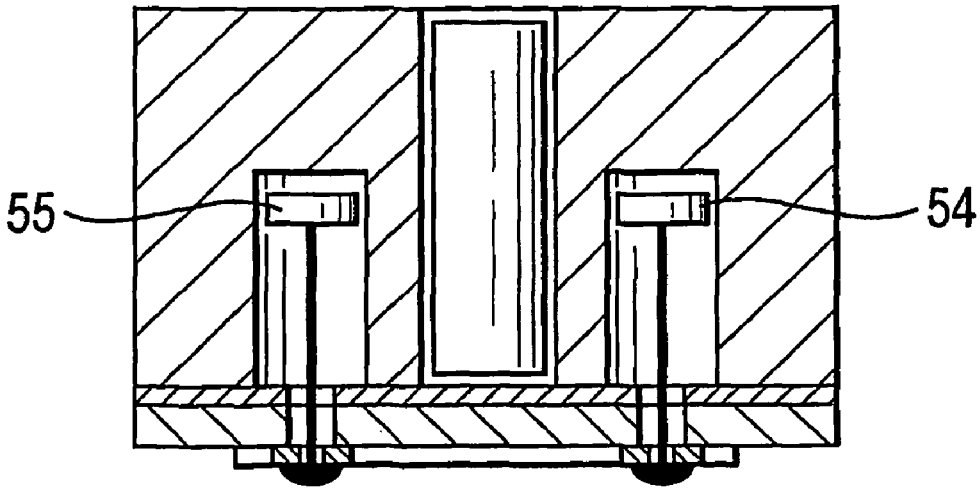
FIG. 7 is another similar view showing another alternative antenna configuration.
Figure 9:
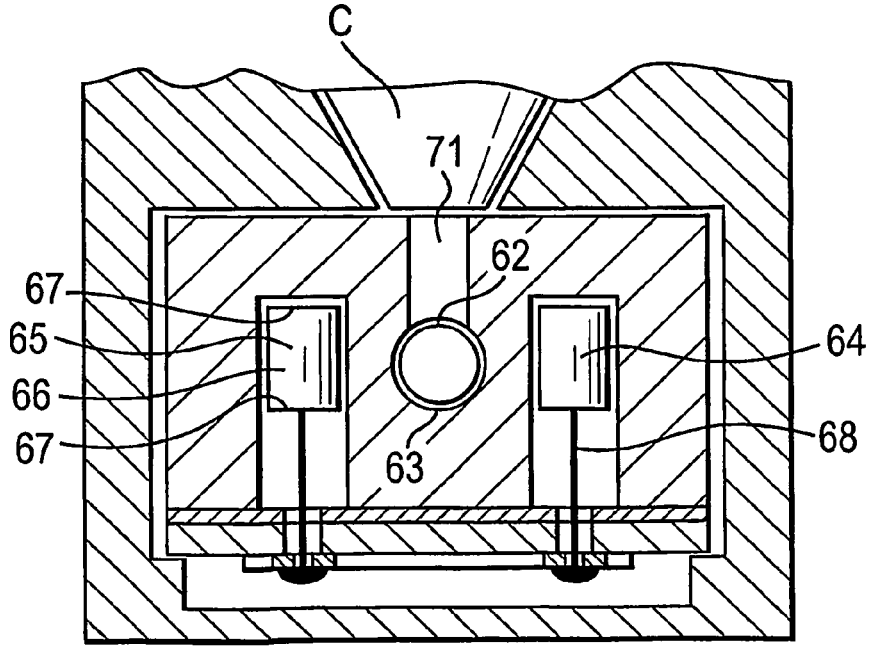
FIG. 9 is a view similar to FIG. 3 of the second lamp.

The invention is not intended to be restricted to the details of the above described embodiment. For instance, FIG. 6 shows the wire antennae 14,15 replaced by spheres 34,35. FIG. 7 shows the another alternative antenna configuration of discs 54,55. Again FIG. 9 shows antennae 64,65 which are hollow metal cylinders 66 with closed ends 67, the back one of which has a central connection wire 68. The cylinders are slightly smaller in diameter than the bulb, namely 4.5 mm, with the same diameter as the bulb, with the antenna voids being 4.75 mm in diameter.

Figure 8:
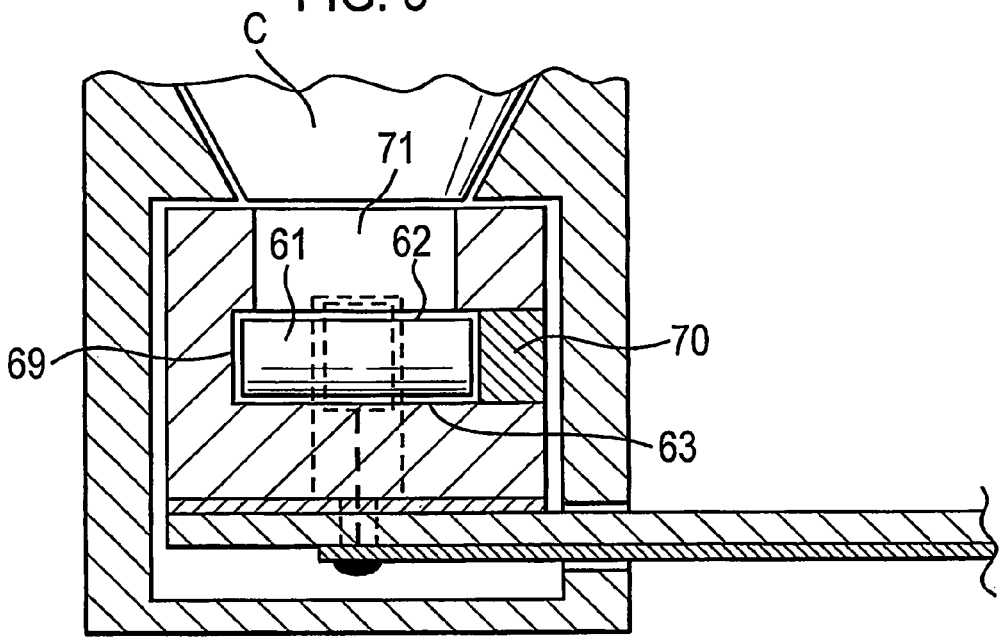
FIG. 8 is a view similar to FIG. 2, but taken through the bulb, of a second lamp of the invention.

Further, FIGS. 8 and 9 show an alternative arrangement for light to leave the bulb. Whereas in the first embodiment, the light leaves the bulb longitudinally from an end 33, remote from the circuit board 21; in the embodiment of FIGS. 8 and 9, the bulb 61 is arranged for light to leave laterally from a side 62. Again in distinction from the first embodiment, the central void 63 for the bulb is arranged parallel with the circuit board, having the bulb captive between a blind end 69 and a plug 70. The wave guide has a slot-like opening 71 to its side remote from the circuit board, through which light from the bulb can leave the bulb towards a collimator C.

Figure 10:
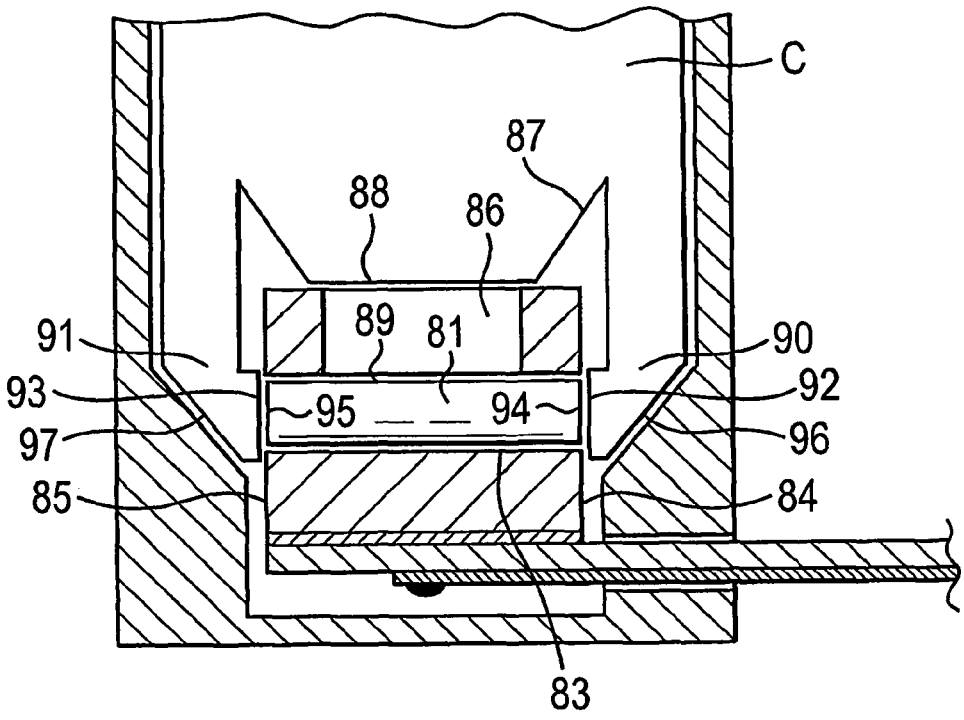
FIG. 10 is a view similar to FIG. 8 of a third lamp of the invention.

FIG. 10 shows another embodiment, which incorporates the arrangement of both the first two embodiments and in addition a further arrangement of the light leaving the bulb from both ends of the bulb. Again the bulb 81 is arranged in a to central void 83 parallel with the circuit board. However, unlike the arrangement of FIGS. 8 and 9, the void is open at opposite sides 84,85 of the wave guide, namely the two sides extending away from the circuit board. Also in the front face, the wave guide has an opening 86. Thus light can leave the bulb in three directions. To collect the light and collimate it, the collimator C has:

- a tapering portion 87 and flat light entry 88 gathering light from the slot 86 and the side 89 of the bulb, together with
- two branches 90,91 with flat light entries 92,93 opposite the ends 94,95 of the bulb. The branches have oblique flats 96,97 for turning the light leaving axially of the bulb to be in the same general direction as the light leaving sideways via the slot 86.

The collimator combines the light from these three paths into a single beam.

Figure 11:
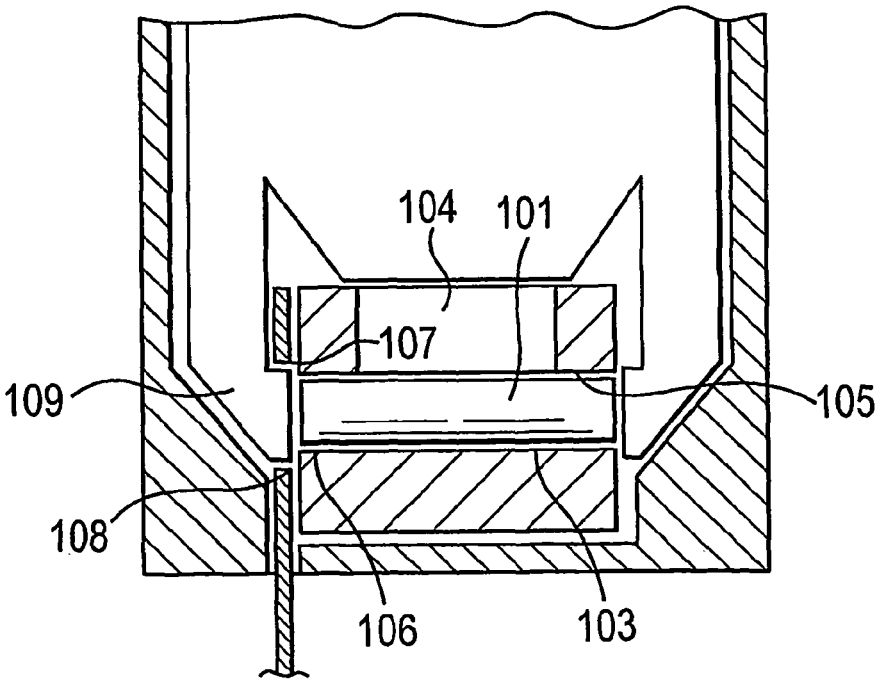
FIG. 11 is a yet further similar view of a fourth lamp of the invention.

FIG. 11 shows an essentially similar embodiment, except that the orientation of the bulb 101 and the central void 103 are turned back to that of the first embodiment. The slot 104 to the side of the bulb faces parallel with the printed circuit board. One of the openings 105 at the end of the bulb faces away from the board and the other 106 is in register with openings 107,108 in the circuit board and the insulation board, whereby light leaving the bulb in this direction passes through the boards to the branch 109 of the collimator. The latter has the same configuration as the collimator of FIG. 10.

The invention claimed is:

1. A lamp having an electrodeless bulb, the lamp comprising:

a drive device adapted to drive at least two antennae;

a ceramic wave guide;

at least two respective voids receiving the said antennae in the wave guide; and a central void in the wave guide, for receiving the bulb, equally spaced from the antenna voids, the central void having:

a physical opening through which light can pass from the bulb and out of the wave guide, wherein the central void is elongate, and includes a diameter, and a length greater than the central void's diameter, and the physical opening is a lateral opening intermediate the ends of the central void.

2. A lamp as claimed in claim 1, wherein the bulb and antenna voids are circularly cylindrical.

3. A lamp as claimed in claim 1, wherein three antennae in three wave guide voids are provided, the voids being equally circumferentially spaced from each other and equally radially spaced from the bulb void.

4. A lamp as claimed in claim 1, wherein the central lamp void is parallel with the said antennae voids.

5. A lamp as claimed in claim 1, wherein the lamp void is orthogonal to the said antennae voids.

6. A lamp as claimed in claim 1, wherein the central void has length and the physical opening is at least one of its ends.

7. A lamp as claimed in claim 1, wherein the central void has length and there is one physical opening at least one of its ends and another lateral opening intermediate its ends.

8. A lamp as claimed in claim 6, wherein physical openings are provided at both ends of the central void and a collimator is provided for receiving light from opposite ends of the bulb and directing it into a common direction.

9. A lamp as claimed in claim 7, wherein physical openings are provided at both ends of the central void and a collimator is provided for receiving light from opposite ends of the bulb and from the lateral opening and directing it into a common direction.

* * * * *